United States Patent [19]

Arcamonte

[11] 4,176,475

[45] Dec. 4, 1979

[54] FOOTWEAR CONSTRUCTED FROM A SINGLE PIECE OF MATERIAL

[76] Inventor: Lucy M. Arcamonte, 780 Nightingale Ave., Miami Springs, Fla. 33166

[21] Appl. No.: 901,624

[22] Filed: May 1, 1978

[51] Int. Cl.[2] ..... A43B 1/02

[52] U.S. Cl. ..... 36/9 R

[58] Field of Search ..... 36/9, 10, 47–49; 12/142 G

[56] References Cited

U.S. PATENT DOCUMENTS

| | | | |
|---|---|---|---|
| 1,258,024 | 3/1918 | Laybourn | 36/9 R |
| 1,910,251 | 5/1933 | Joha | 36/9 R |
| 2,177,321 | 10/1939 | Iwan | 12/142 G |
| 3,793,748 | 2/1974 | Pursley | 36/9 R |

FOREIGN PATENT DOCUMENTS

| | | | |
|---|---|---|---|
| 1385328 | 11/1964 | France | 36/48 |

*Primary Examiner*—James Kee Chi

*Attorney, Agent, or Firm*—Salvatore G. Militana

[57] ABSTRACT

A footwear constructed from a single piece of material with a fleece-like surface having its outline cut into an appropriate shape and in accordance with the desired size of footwear with markings thereon to indicate where the cloth is to be sewn, folded and tucked and when completed the footwear is turned inside out to form the footwear having the fleece-like surface exposed on the outer and inner surfaces of the footwear.

2 Claims, 8 Drawing Figures

FOOTWEAR CONSTRUCTED FROM A SINGLE PIECE OF MATERIAL

CROSS REFERENCE TO RELATED APPLICATION

This application is a copending application of my application Ser. No. 817,621, filed on July 21, 1977, for Footwear and now abandoned.

BACKGROUND OF THE INVENTION

1. Field Of The Invention

This invention relates to footwear and is particularly directed to the manufacture of footwear from a single piece of marked material.

2. Description Of The Prior Art

The conventional footwear such as slippers, moccasins and the like are produced from patterns that require a plurality of pieces of material to be sewn together to form a single footwear. When it is considered that patterns have to be produced for each size of footwear, one will realize the large number of pieces of material that have to be precut, stored and sewn together in order to produce conventional slippers. Costs of manufacture are inordinately high due to the skilled labor required to cut and sew the pattern pieces together and the requirement to match the proper cut pieces of material together. The present invention avoids the necessity of having to cut and sew many pieces of material together, but instead, utilizes one piece of material that is cut into an appropriate shape, is marked to indicate where the material is to be sewn, folded or tucked and when accomplished, the footwear need only be turned inside out to become completed with a lining positioned within the footwear.

SUMMARY OF THE INVENTION

Therefore, a principal object of the present invention is to produce a footwear with a lining included, such as slippers, moccasins and the like, from a single piece of material which has been appropriately marked for folding and sewing and having a fleece-like surface exposed on the outer and lining surfaces of the footwear.

Another object of the present invention is to produce a footwear in simple steps of production whereby cost of labor is minimal and normally lesser degree of skill at sewing is required rather than in the manufacture of conventional footwear.

A still further of the present invention is to produce a footwear wherein a single pattern is required for each size of footwear thereby reducing the requirement of large number of pieces of material that has to be cut and stored for each size of footwear.

With these and other objects in view, the invention will be best understood from a consideration of the following detailed description taken in connection with the accompanying drawings forming a part of this disclosure with the understanding, however, that the invention is not confined to any strict conformity with the showing of the drawings but may be changed or modified so long as such changes or modifications mark no material departure from the salient features of the invention as expressed in the appended claims.

DESCRIPTION OF THE PREFFERED EMBODIMENT

Figure 1:
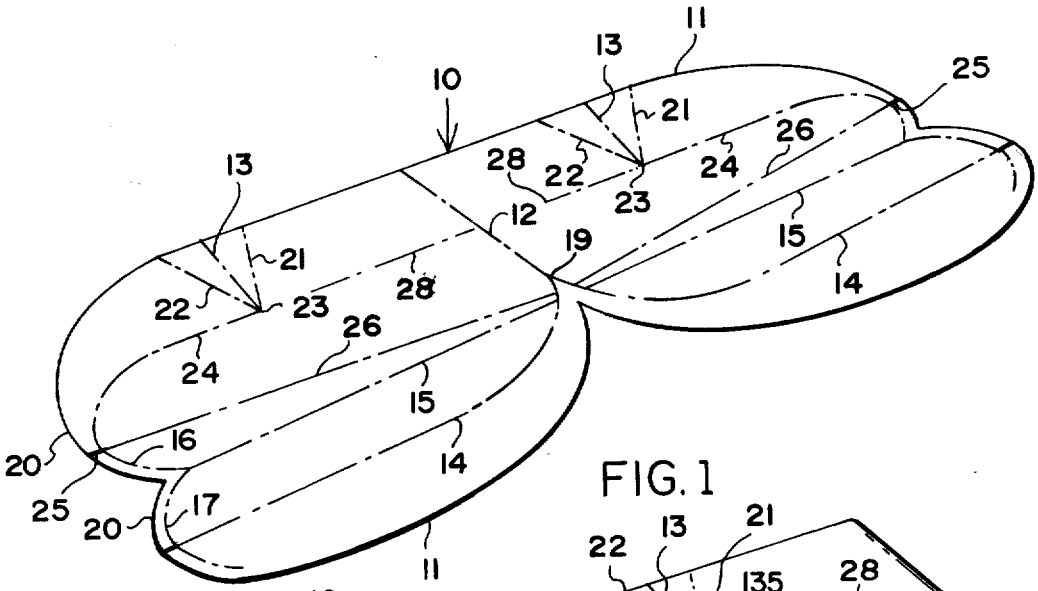
FIG. 1 is a perspective view of a single piece of material forming the pattern marked as shown for the production of a footwear.
Figure 2:
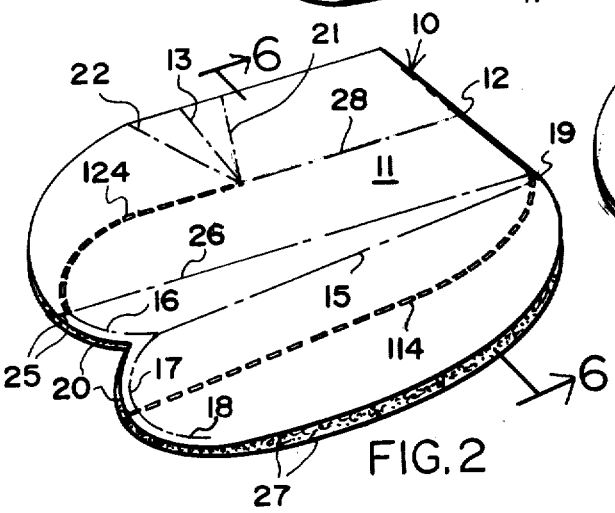
Figure 5:
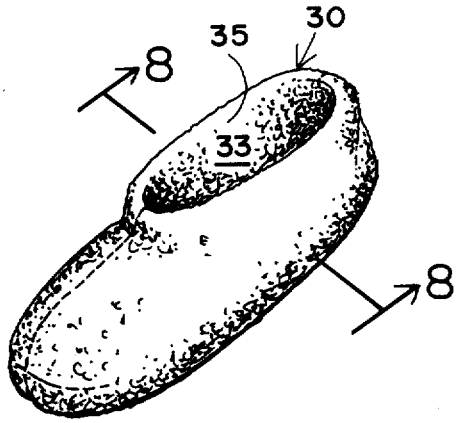
FIG. 5 is a perspective view of the completed footwear.

Referring to the drawings wherein like numerals are used to designate similar parts throughout the various figures and in particular FIG. 1, the numeral 10 refers to a pattern showing the markings to be made on a single piece of cloth or other material from which my footwear 30 is produced. FIGS. 2 and 5 inclusive indicate progressive steps of folding and sewing to produce my completed footwear 30. The preferred material used to produce my footwear 30 is provided with fleece-like material on one surface as shown in the drawings.

The single piece of cloth 10 is cut in accordance with the shape shown by FIG. 1 to form two identical half patterns 11 extending from the centerline 12 about which the members 11 are to be folded in superimposed relation to form the heel portion of the footwear 30 as shown by FIG. 2 as the first step in the manufacture of my footwear 30. Extending longitudinally across each of the patterns 11 from the outer edge to the centerline 12 are relatively straight line markings 14 and 15 with the marking 14 terminating in a curved portion that extends to the centerline 12 as at 19. Markings 15 terminate at the curved portion of the markings 14. Marking 25 which is cut extends transversely for a relatively short distance from the outer edge of the patterns 11. Extending from the marking 25 is marking 26 that extends to and terminates at the juncture of the markings 14 and 15 as at 19.

Arcuate markings 17 and 18 follow in substantially parallel relation with the outer contour 20 of the pattern 11 joining at the marking 14 with the marking 17 terminating at the end of the straight line marking 15. Arcuate marking 16 similar to marking 17 joins the latter at the straight line marking 15. Markings 21 and 22 which when folded on a centerline 13 from a dart 40 extend in a -V- shape commencing at position 23 extending in a direction away from each other to the outer edge of the pattern 11. Marking 28 extends from the centerline marking 12 to the intersection 23 of lines 21 and 22 in somewhat a straight line and then continues on as a straight line marking 24, then curving downwardly to join the marking 16 at the position of the marking 25 which extends transversely from the outer edge of the pattern 11.

Figure 3:
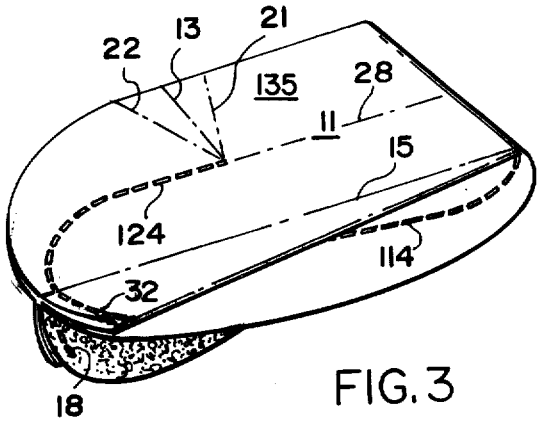
FIGS. 2 to 4 inclusive are perspective views showing the progressive steps in the production of the footwear.
Figure 6:
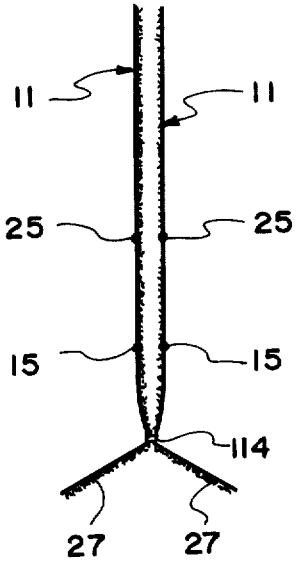
FIG. 6 is a front elevational view of the footwear as shown by FIG. 2.
Figure 7:
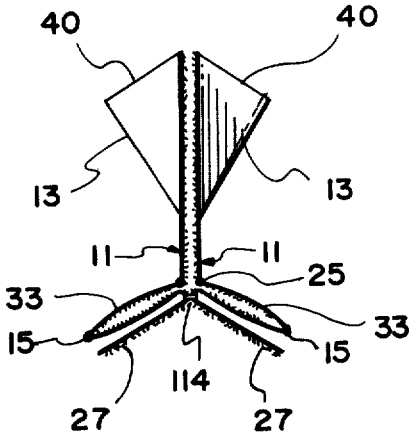
FIG. 7 is a top plan view of the footwear shown by FIG. 4.
Figure 8:
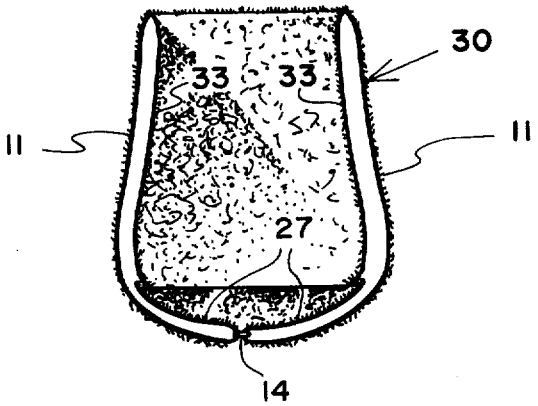
FIG. 8 is a cross sectional view taken along the line 8—8 of FIG. 5.

With markings made on the patterns 11 as shown by FIG. 1, the first step taken toward the production of the footwear 30 is to fold the identically shaped patterns 11 on the centerline 12 in superimposed relation to form the heel portion as shown by FIG. 2. The half patterns 11 are then sewn together along the markings 14 indicated as stitching 114 which form first flaps 27. When the footwear 30 is completed the flaps 27 will form the inner soles thereof. The markings 24 are now stitched shown as stitching 124 as shown by FIG. 2 to join the two half patterns 11 at what becomes the front or toe portion of the footwear 30 to form the toe portion thereof and an inner lining therefor. Each of the first flaps 27 are now folded along the stitching 114 in a direction away from each other in approximately coplanar relation with the markings 16 and 17 becoming superimposed. Stitches 32 are taken along the markings 16, 17 on each flap 27 to complete the toe portion of the footwear 30 as shown by FIGS. 3 and 6. It is to be noted that the two half patterns 11 folded at markings 12 are now sewn together about their perimeters at stitchings 114, 32 and 124 forming a second flap 135 leaving an opening 35 through which a person inserts his foot in order to wear the footwear 30. However, this opening 35 is too large, thereby requiring darts or tucks 40 to be made on each half pattern 11 at the opening 35. This is done by folding the material along marking 13 so as to superimpose the markings 21 and 22 on each half pattern 11 and sewing along the markings 21, 22 to form the darts 40.

Figure 4:
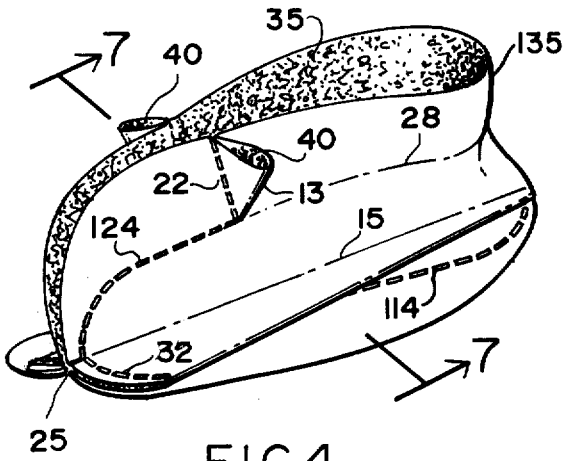

At this time, the footwear 30 is complete in its construction except that it is inside out, as shown by FIG. 4 with the fleece-like surface positioned on the inside of the footwear 30. A person then inserts his hand into the opening 35, reaches into the forward or toe end of the footwear 10 grasping the patterns 11 at the cut portion 25 and withdraws his hand from the openings 35 pulling that toe portion of the patterns 11 through the opening 35 until the patterns 11 are in reverse position and footwear 30 taking shape. The flaps 27 lie flat within the footwear 30 to form the inner sole thereof. The half patterns 11 are then folded at the markings 28 inwardly of the opening 35 whereby the portions 33 become the inner lining 26 of the footwear 30 along with the flaps 27 to form a complete inner lining for the footwear 30. Both the outside surface and the inside surface are provided with the fleece-like surface of soft pile or fabric necessary for comfort derived from the use of house slippers and the like. It is noted from the above discussion that the present invention is capable of producing a footwear that can be produced completely having fleece-like surfaces on the outer and inner surfaces of the footwear from a single piece of fabric or other pliable material properly marked for folding and sewing, thereby reducing to a minimum the cost and complexity of manufacturing footwear.

What I claim as new and desire to secure by Letters Patent is:

1. A footwear having heel and toe portions produced from a single piece of material having a fleece-like surface comprising a pair of symmetrically disposed portions folded at a mid-portion, one upon the other in superimposed relation with said outer surfaces in contact relation, said mid-portion forming said heel of said footwear, stitches sewn on said superimposed portions from said heel to said toe along a bottom portion in spaced relation to the outer edges of said superimposed portions forming a pair of first flaps, stitches sewn along a top portion from said toe to a position removed from said heel forming an opening in said footwear, said last named stitches being positioned in spaced relation to the top edge portion to form a second flap whereby upon folding said first and second flaps and turning said footwear inside out, said flaps become inner linings for said footwear with said fleece-like surface exposed on all portions of said footwear.

2. The structure as recited by claim 1 where a plurality of tucks are positioned along said top portion at said opening for providing an opening of desired size.

* * * * *